US008776495B2

(12) United States Patent
Gonze et al.

(10) Patent No.: US 8,776,495 B2
(45) Date of Patent: Jul. 15, 2014

(54) EXHAUST GAS AFTERTREATMENT SYSTEM AND METHOD OF OPERATION

(75) Inventors: Eugene V. Gonze, Pinckney, MI (US); Michael J. Paratore, Jr., Howell, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 932 days.

(21) Appl. No.: 12/880,662

(22) Filed: Sep. 13, 2010

(65) Prior Publication Data

US 2012/0060471 A1 Mar. 15, 2012

(51) Int. Cl.
*F01N 3/035* (2006.01)

(52) U.S. Cl.
USPC ..... 60/284; 60/286; 60/303

(58) Field of Classification Search
USPC ..... 60/286, 295, 297, 300, 301, 303
See application file for complete search history.

(56) References Cited

U.S. PATENT DOCUMENTS

2006/0179825 A1* 8/2006 Hu et al. ..... 60/297
2007/0277515 A1* 12/2007 Igarashi ..... 60/303
2008/0223019 A1* 9/2008 Gonze et al. ..... 60/286
2010/0037607 A1 2/2010 Doring
2010/0290957 A1* 11/2010 Yoshida et al. ..... 422/109
2011/0000190 A1* 1/2011 Svensson et al. ..... 60/274

FOREIGN PATENT DOCUMENTS

CN 101676528 A 3/2010
JP 2009228575 A 10/2009

OTHER PUBLICATIONS

Notice of Rejection regarding related case No. CN201110316697.X, dated Aug. 20, 2013, 7 pgs.

* cited by examiner

*Primary Examiner* — Kenneth Bomberg
*Assistant Examiner* — Jonathan Matthias
(74) *Attorney, Agent, or Firm* — Cantor Colburn LLP

(57) ABSTRACT

An exhaust gas after treatment system for an internal combustion engine comprises an oxidation catalyst device having a first substrate, a heater, and a second substrate disposed serially between the inlet and the outlet. A hydrocarbon supply is connected to and is in fluid communication with the exhaust system upstream of the oxidation catalyst device for delivery of a hydrocarbon thereto. The heater is configured to oxidize the hydrocarbon therein and to raise the temperature of the second substrate and exhaust gas passing therethrough.

13 Claims, 3 Drawing Sheets

EXHAUST GAS AFTERTREATMENT SYSTEM AND METHOD OF OPERATION

FIELD OF THE INVENTION

Exemplary embodiments of the present invention relate to exhaust gas treatment systems for internal combustion engines and, more particularly, to an efficient system for reaching operational temperatures.

BACKGROUND

The exhaust gas emitted from an internal combustion engine, particularly a diesel engine, is a heterogeneous mixture that contains gaseous emissions such as carbon monoxide ("CO"), unburned hydrocarbons ("HC") and oxides of nitrogen ("$NO_x$") as well as condensed phase materials (liquids and solids) that constitute particulate matter ("PM"). Catalyst compositions typically disposed on catalyst supports or substrates are provided in an engines exhaust system to convert certain, or all of these exhaust constituents into non-regulated exhaust gas components.

A technology that has been developed to reduce the levels of NO emissions in lean-burn engines (ex. diesel engines) that burn fuel in excess oxygen includes a selective catalytic reduction ("SCR") device. The SCR catalyst composition preferably contains a zeolite and one or more base metal components such as iron ("Fe"), cobalt ("Co"), copper ("Cu") or vanadium which can operate efficiently to convert NO constituents in the exhaust gas in the presence of a reductant such as ammonia ('$NH_3$"). Although the use of a catalyst aides in the reduction of activation energy required for the SCR device, the ever increasing efficiency of diesel and other lean burn engines results in cooler exhaust temperatures when moderately operated and following engine start-up. Such cooler operating temperatures delay the operational start-up of the SCR device, which needs to reach a minimum operating temperature to effectively reduce $NO_x$.

Typically, an SCR may not reach appropriate operating temperatures until several minutes after the engine is started which is no longer feasible in view of ever tightening motor vehicle emissions regulations. A primary contributor to slow catalyst light-off, besides the lower exhaust temperatures experienced, is the thermal mass of the engine and the exhaust system that extends between the engine and the SCR device. The thermal mass may include the engine, the engine exhaust manifold, an oxidation catalyst ("OC") device as well as the exhaust conduit. A reduction in the thermal mass that must be heated upstream of an SCR device following an engine cold start will reduce the time to SCR operation and the reduction of $NO_x$ emitted by the exhaust system.

SUMMARY OF THE INVENTION

In an exemplary embodiment of the invention, an exhaust gas after treatment system for an internal combustion engine comprises an exhaust gas conduit in fluid communication with, and configured to receive an exhaust gas from, the internal combustion engine and an oxidation catalyst device having an inlet and an outlet in fluid communication with the exhaust gas conduit and having a first substrate, a heater, and a second substrate disposed between the inlet and the outlet. A hydrocarbon supply is connected to and is in fluid communication with the exhaust gas conduit upstream of the oxidation catalyst device for delivery of a hydrocarbon thereto and formation of an exhaust gas and hydrocarbon mixture therein and wherein the heater is configured to oxidize the hydrocarbon therein and to raise the temperature of the second substrate and the exhaust gas passing therethrough.

In another exemplary embodiment of the invention, an exhaust gas after treatment system for an internal combustion engine comprises an exhaust gas conduit in fluid communication with, and configured to receive an exhaust gas from, the internal combustion engine an oxidation catalyst device having an inlet and an outlet in fluid communication with the exhaust gas conduit and having a first substrate, an electric heater, and a second substrate disposed serially between the inlet and the outlet, the first substrate having a larger thermal mass than the second substrate, a hydrocarbon supply connected to and in fluid communication with the exhaust gas conduit upstream of the oxidation catalyst device for delivery of a hydrocarbon thereto and formation of an exhaust gas and hydrocarbon mixture therein, an electrical supply connected to the electric heater and configured to raise the temperature of the heater to oxidize the hydrocarbon therein and to raise the temperature of the second substrate and the exhaust gas passing therethrough and a selective catalyst reduction device having an inlet and an outlet in fluid communication with the exhaust gas conduit downstream of the oxidation catalyst device and configured to receive the heated exhaust gas therefrom.

In yet another exemplary embodiment of the invention a method for operating a portion of an exhaust gas after treatment system for an internal combustion engine having an exhaust gas conduit in fluid communication with, and configured to receive an exhaust gas from, the internal combustion engine, an oxidation catalyst device having an inlet and an outlet in fluid communication with the exhaust gas conduit and having a first substrate, a heater, and a second substrate disposed serially between the inlet and the outlet, the first substrate having a larger thermal mass than the second substrate, a hydrocarbon supply connected to and in fluid communication with the exhaust gas conduit upstream of the oxidation catalyst device for delivery of a hydrocarbon thereto and formation of an exhaust gas and hydrocarbon mixture therein, and a selective catalyst reduction device having an inlet and an outlet in fluid communication with the exhaust gas conduit downstream of the oxidation catalyst device and configured to receive the heated exhaust gas therefrom comprises monitoring the temperature of the selective catalyst reduction device, determining if the temperature is at a level at which it can reduce $NO_x$ in the exhaust gas, activating the heater if it is determined that the temperature is less than required for reduction of $NO_x$ in the exhaust gas, monitoring the temperature of the heater to determine if the temperature is at a level at which it can oxidize hydrocarbon in the exhaust gas and activating the fuel injector if the temperature of the heater has reached a temperature at which it can oxidize hydrocarbon in the exhaust gas.

The above features and advantages, and other features and advantages of the present invention are readily apparent from the following detailed description of the invention when taken in connection with the accompanying drawings.

BRIEF DESCRIPTION OF THE DRAWINGS

Other objects, features, advantages and details appear, by way of example only, in the following detailed description of the embodiments, the detailed description referring to the drawings in which.

DESCRIPTION OF THE EMBODIMENTS

Figure 1:
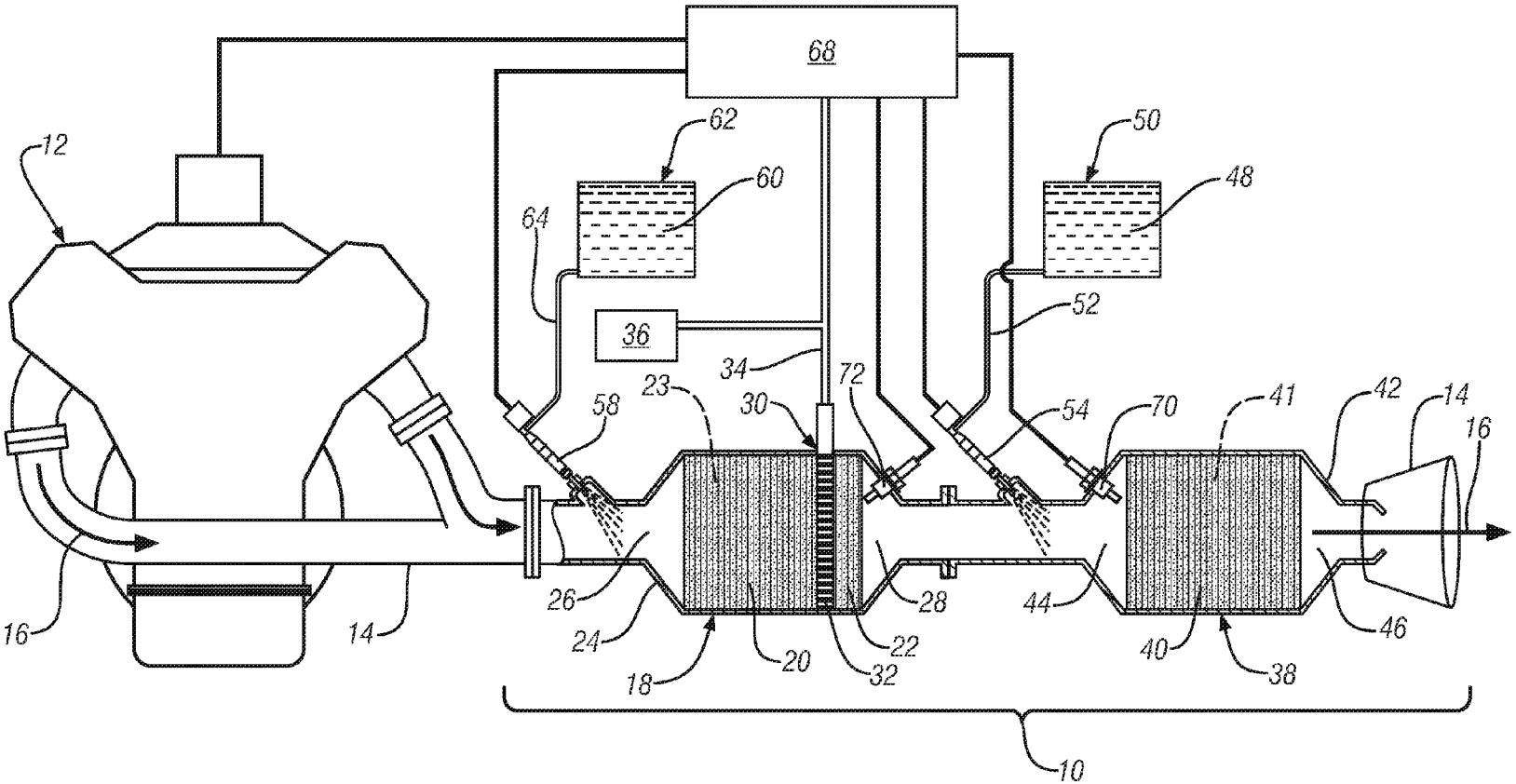
FIG. 1 is a schematic view of an exhaust gas treatment system for an internal combustion engine.

The following description is merely exemplary in nature and is not intended to limit the present disclosure, application or uses. It should be understood that throughout the drawings, corresponding reference numerals indicate like or corresponding parts and features.

Referring now to FIG. 1, an exemplary embodiment of the invention is directed to an exhaust gas treatment system 10, for the reduction of regulated exhaust gas constituents of an internal combustion engine 12. It is appreciated that the internal combustion engine 12 may include, but is not limited to diesel engine systems, gasoline direct injection engine systems and homogeneous charge compression ignition engine systems.

The exhaust gas treatment system 10 includes an exhaust gas conduit 14, which may comprise several segments that function to transport exhaust gas 16 from the internal combustion engine 12 to the various exhaust treatment devices of the exhaust gas treatment system 10. In the exemplary embodiments shown, the exhaust treatment devices include an Oxidation Catalyst ("OC") device 18. In an exemplary embodiment, the OC device 18 includes first and second flow-through metal or ceramic monolith substrates 20 and 22 that are packaged serially in a rigid shell or canister 24 between an inlet 26 and an outlet 28 that are in fluid communication with exhaust gas conduit 14 and configured to facilitate the flow of exhaust gas 16 therethrough. The substrates 20 and 22 have an oxidation catalyst compound 23 disposed thereon. In the exemplary embodiment shown, the oxidation catalyst compound may be applied as a wash coat and may contain platinum group metals such as platinum (Pt), palladium (Pd), rhodium (Rh) or other suitable oxidizing catalysts, or combination thereof. The OC device 18 is useful in treating unburned gaseous and non-volatile HC and CO emitted from the engine as part of the exhaust gas 16 and which are oxidized to form carbon dioxide and water.

In an exemplary embodiment, in a typical small to medium duty vehicle application the total volume of the substrates 20 and 22 is in the range of about 4 to 6 liters with the first, upstream substrate 20 having a volume in the range of 2 to 4 liters and the second, downstream substrate 22 having a volume in the range of about 1 to 2 liters. With a volume range of about 1 to 2 liters, the second, downstream substrate 22 has a significantly lower thermal mass than the first substrate 20. An heater, such as electric heater 30, is disposed within canister 24 of the OC device 18 between the first and second substrates 20 and 22 (may be referred to as "mid-brick"). In an exemplary embodiment the electric heater 30 may be constructed of any suitable material that is electrically conductive such as a wound or stacked metal monolith 32. An electrical conduit 34 that is connected to an electrical system, such as a vehicle electrical system 36, supplies electricity to the electric heater 30 to thereby raise the temperature of the monolith 32, as will be further described below. Like substrates 20 and 22, an oxidation catalyst compound (not shown) may be applied to the electric heater 30 as a wash coat and, in the embodiment shown, contains platinum group metals such as platinum (Pt), palladium (Pd), rhodium (Rh) or other suitable oxidizing catalysts, or combination thereof.

In an exemplary embodiment, a Selective Catalytic Reduction ("SCR") device 38 is disposed downstream of the OC device 18. In a manner similar to the OC device 18, the SCR device 38 may include a flow-through ceramic or metal monolith substrate 40 that is packaged in a rigid shell or canister 42 having an inlet 44 and an outlet 46 in fluid communication with exhaust gas conduit 14 and configured to facilitate the flow of exhaust gas 16 therethrough. The substrate 40 has an SCR catalyst composition 41 applied thereto. The SCR catalyst composition 41 contains, in the embodiment shown, a zeolite and one or more base metal components such as iron ("Fe"), cobalt ("Co"), copper ("Cu") or vanadium which efficiently converts $NO_x$ constituents in the exhaust gas 16 in the presence of a reductant such as ammonia ('$NH_3$") and at temperatures that are in the range of 200° C. When operating temperatures of the SCR device 38 are below the active operating temperature, untreated exhaust gas 16 can pass through the SCR device 38 and be emitted from the exhaust gas after treatment system 10.

In an exemplary embodiment, the $NH_3$ reductant 48, supplied from reductant supply tank 50 through conduit 52, is injected into the exhaust gas conduit 14 at a location upstream of the SCR device 38 using a reductant injector 54, in fluid communication with exhaust gas conduit 14, or other suitable method of delivery of the reductant to the exhaust gas 16. The reductant, in the embodiment shown, is in the form of a gas, a liquid or an aqueous urea solution and may be mixed with air in the reductant injector 54 to aid in the dispersion of the injected spray.

In an exemplary embodiment, disposed upstream of the OC device 18, in fluid communication with the exhaust gas 16 in the exhaust gas conduit 14, is fuel injector 58. The fuel injector 58, in fluid communication with an HC containing fuel 60 in fuel supply tank 62 through fuel conduit 64, is configured to introduce unburned, hydrocarbon containing fuel 60 into the exhaust gas stream for delivery to the OC device 18.

A controller such as a powertrain or a vehicle controller 68 is operably connected to, and monitors, the exhaust gas treatment system 10 through signal communication with a number of sensors such as temperature sensor 70 which monitors the temperature near the inlet 44 of the SCR device 38 and temperature sensor 72 which monitors the temperature near the outlet 28 of the OC device 18. As used herein the term controller may include an application specific integrated circuit (ASIC), an electronic circuit, a processor (shared, dedicated or group) and memory that executes one or more software or firmware programs, a combinational logic circuit, and/or other suitable components that provide the described functionality.

Figure 3:
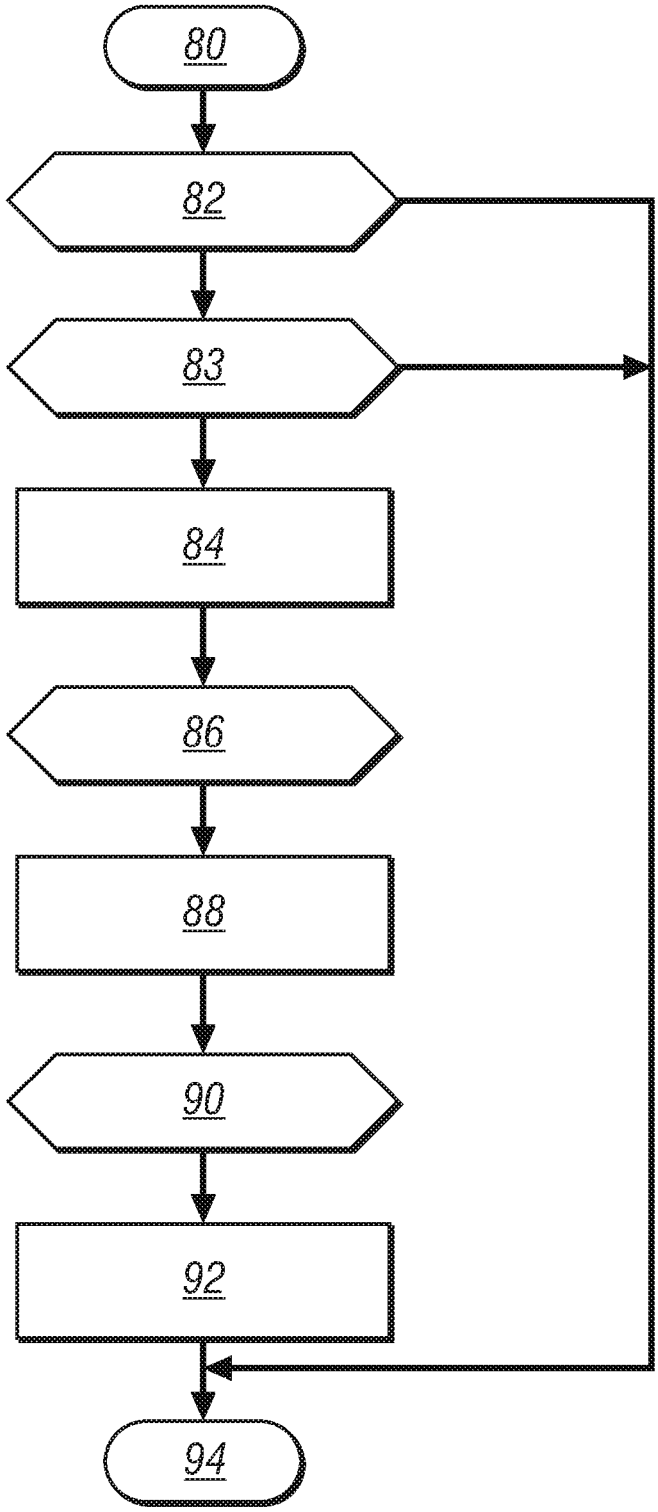
FIG. 3 is an operational diagram illustrating an operating mode of a portion of the exhaust gas treatment system embodying aspects of the present invention.

With reference to FIG. 3, an exemplary embodiment of the operation of a portion of the exhaust after treatment system 10 is illustrated. This operation starts at 80 and may run continuously following a cold start of the internal combustion engine 12. The controller 68 monitors at 82, through temperature sensor 70, the temperature adjacent the inlet 44 of the SCR device 38 to determine if the temperature is at a level (about 200° C. or above) at which it can reduce the levels of $NO_x$ in the exhaust gas 16. If the controller 68 determines at 83 that the temperature is less than required for SCR catalyst operation, or light-off, it will activate the electric heater 30 at 84. If the temperature is sufficient for SCR catalyst operation, or light-off, the operation ends at 94. The controller 68 monitors at 86, through the temperature sensor 72, or a model to simulate the temperature, adjacent the outlet 28 of the OC device 18 to determine if the temperature of the electric heater 30 is at a level (about 250° C. or above) at which it can oxidize or combust HC containing fuel 60 in the exhaust gas 16. If the controller 68 determines at 86 that the temperature of the electric heater 30 has reached a temperature at which it can oxidize or combust fuel it will activate the fuel injector 58 at 88 and deliver fuel 60 into the exhaust gas 16.

The injected fuel 60 will combust when it passes through the electric heater 30 and will rapidly heat the smaller, second substrate 22. Due to its low thermal mass, relative to the total volume of the OC device 18, the second substrate 22 will reach an oxidation temperature (about 250° C. or above) in significantly less time than would be required if the entire OC device 18 were required to heat. As a result of the oxidation of the fuel 60 in the electric heater 30 and the second substrate 22 of the OC device 18, the temperature of the exhaust gas 16 is raised significantly and, as a result rapidly raises the temperature of the SCR device 38 to its operational temperature. The controller 68 monitors at 90, through temperature sensor 70, the temperature adjacent the inlet 44 of the SCR device 38 to determine if the temperature is at a level (about 200° C. or above) at which it can reduce the levels of $NO_x$ in the exhaust gas 16. If the controller 68 determines at 90 that the temperature is at or above that required for SCR catalyst operation, or light-off, it will de-activate the electric heater 30 at 92 and reduce or stop the flow of fuel 60 through fuel injector 58. At the same time it will activate the reductant injector 54 to deliver the ammonia reductant 48 to the exhaust gas 16 within the exhaust gas conduit 14. During operation of the internal combustion engine 12, the controller 68 will continue to monitor, at 83, the temperatures of the OC device 18 and the SCR device 38 and, if it is determined that the temperature of either device falls below its operational level, the operation may be repeated to re-establish appropriate operating temperatures of the two devices. In an exemplary embodiment, the operation ends at 94 when the internal combustion engine 12 is turned off.

Figure 2:
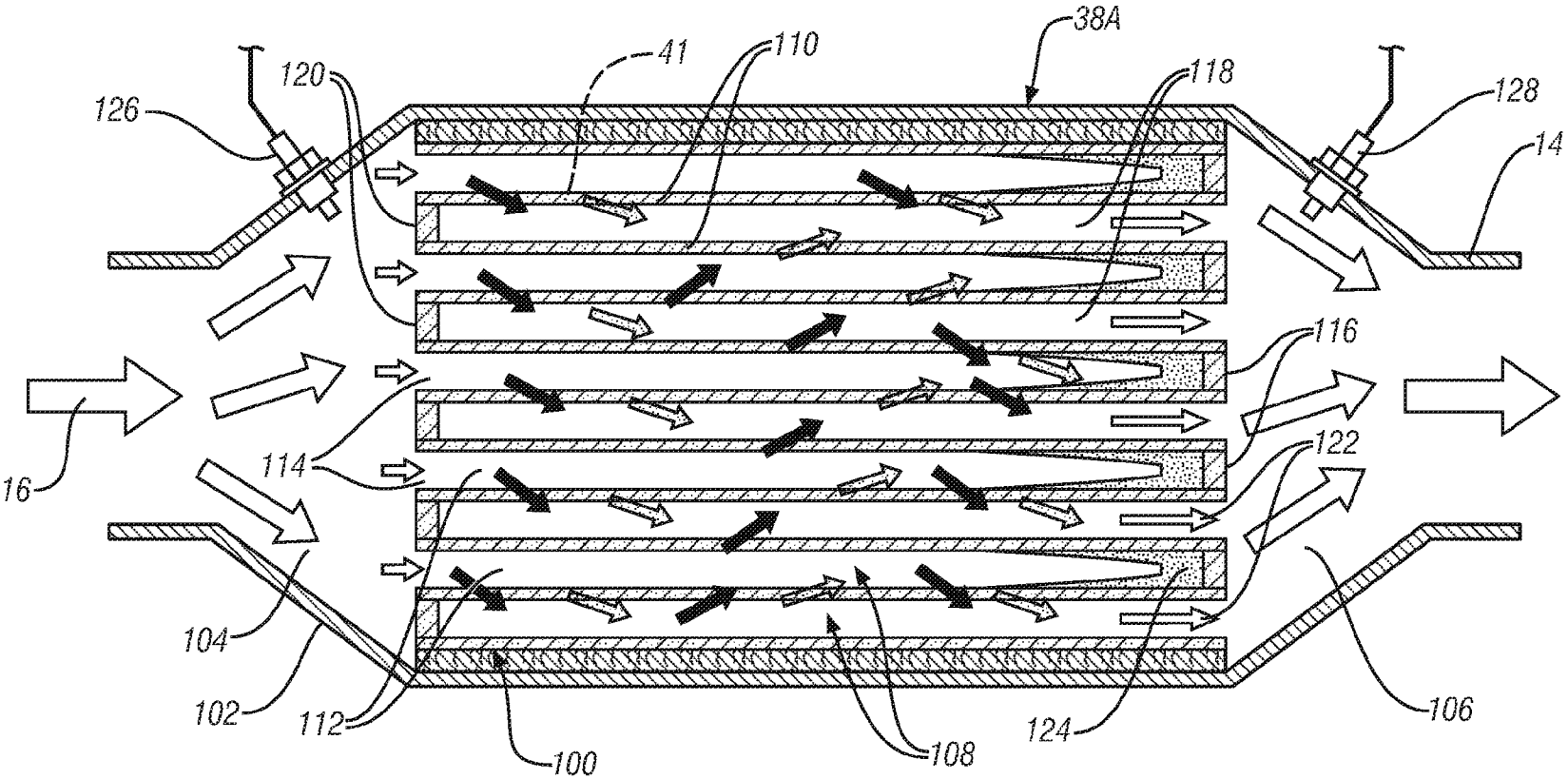
FIG. 2 is a sectional view of an exemplary embodiment of a 2-way SCR/PF device embodying aspects of the present invention.

Referring to FIG. 2, in another embodiment the SCR device 38 may also comprise a Particulate Filter ("PF") device 38A that operates to filter the exhaust gas 16 of carbon and other particulates. The PF device 38A may be constructed using a ceramic wall flow monolith filter 100 that is packaged in a rigid shell or canister 102 having an inlet 104 and an outlet 106 in fluid communication with exhaust gas conduit 14. The ceramic wall flow monolith filter 100 has a plurality of longitudinally extending passages 108 that are defined by longitudinally extending walls 110. The passages 108 include a subset of inlet passages 112 that have an open inlet end 114 and a closed outlet end 116, and a subset of outlet passages 118 that have a closed inlet end 120 and an open outlet end 122. Exhaust gas 16 entering the PF device 38A through the open inlet ends 114 of the inlet passages 112 is forced to migrate through adjacent longitudinally extending walls 110 to the outlet passages 118. It is through this wall flow mechanism that the exhaust gas 16 is filtered of carbon and other particulates 124. The filtered particulates 124 are deposited on the longitudinally extending walls 110 of the inlet passages 112 and, over time, will have the effect of increasing the exhaust gas backpressure experienced by the internal combustion engine 12. It is appreciated that the ceramic wall flow monolith filter 100 is merely exemplary in nature and that the PF device 38A may include other filter devices such as wound or packed fiber filters, open cell foams, sintered metal fibers, etc. In the exemplary embodiment shown, the ceramic wall flow monolith filter 100 of the PF device 38A has an SCR catalyst composition 41 applied thereto. The addition of the SCR catalyst composition 41 to the PF device 38A results in a 2-way exhaust treatment device that is capable of both reducing the $NO_x$ components of the exhaust gas 16 as well as removing carbon and other particulates 124.

In an exemplary embodiment, the increase in exhaust backpressure caused by the accumulation of carbon and other filtered particulates 124 requires that the PF 38A is periodically cleaned, or regenerated. Regeneration involves the oxidation or burning of the accumulated carbon and other particulates 124 in what is typically a high temperature (>600° C.) environment. In an exemplary embodiment, backpressure sensors 126 and 128, located upstream and downstream, respectively, of PF 38A, generate signals indicative of the pressure differential across the ceramic wall flow monolith filter 100 that are used by the controller 68, FIG. 1, to determine the carbon and particulate loading therein. Upon a determination that the backpressure has reached a predetermined level indicative of the need to regenerate the PF 38A, the controller 68 and raises the temperature of the electric heater 30 of the OC device 18 to a level suitable for rapid HC oxidation (about 450° C.). Temperature sensor 72, disposed within the shell 24 of the OC device 18, monitors the temperature of the exhaust gas 16 downstream of the OC device 18. When the electric heater 30 has reached the desired operational temperature, the controller 68 will activate the fuel injector 58 to deliver fuel 60 into the exhaust gas conduit 14 for mixing with the exhaust gas 16. The fuel/exhaust gas mixture enters OC device 18 and flows through the electric heater 30 that induces a rapid oxidation reaction and resultant exotherm. The heated exhaust gas resulting from the oxidation reaction in the heater 30 flows through the second substrate 22 which induces a further, complete oxidation of the HC in the exhaust gas 16 and raises the exhaust gas temperature to a level (>600° C.) suitable for regeneration of the carbon and particulate matter 124 in the ceramic wall flow monolith filter 100. The controller 68 may monitor the temperature of the exothermic oxidation reaction in the ceramic wall flow monolith filter 100 through temperature sensor 70 and adjust the HC delivery rate of fuel injector 58 to maintain a predetermined temperature.

In another exemplary embodiment, it is contemplated that, in some circumstances the fuel injector 58 may be eliminated. Instead, engine control of the hydrocarbon levels in the exhaust gas 16 will be used. When the heater 30 has reached the desired operational temperature, the controller 68 will adjust the timing and rate/frequency of fueling of the internal combustion engine 12 to deliver excess, unburned fuel into the exhaust gas conduit 14 for mixing with the exhaust gas 16.

The embodiments of the invention described herein utilize an electric heater located mid-brick in an oxidation catalyst device in which the upstream substrate is of a larger volume than the catalyst substrate located downstream of the electric heater. The smaller size (about 1 liter versus about 5 liters for instance) and resultant lower thermal mass of the downstream catalyst substrate results in rapid light off and heating of the exhaust gas upstream of an SCR device, a PF device or a combination thereof while using a lower quantity of fuel than would be required if the entire OC device was being used to heat the exhaust gas thereby reducing the $CO_2$ generated during the heating event.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the present application.

What is claimed is:

1. An exhaust gas after treatment system for an internal combustion engine comprising:

an exhaust gas conduit in fluid communication with, and configured to receive an exhaust gas from, the internal combustion engine;

an oxidation catalyst device having an inlet and an outlet in fluid communication with the exhaust gas conduit and having a first substrate, an electric heater, and a second substrate disposed serially between the inlet and the outlet, the first substrate having a larger thermal mass than the second substrate, the electric heater disposed downstream of the first substrate, and the second substrate disposed downstream of the electric heater;

fuel injector coupled to and in fluid communication with the exhaust gas conduit upstream of the oxidation catalyst device for delivery of a hydrocarbon thereto and formation of an exhaust gas and hydrocarbon mixture therein;

an electrical power supply connected to the electric heater and configured to raise the temperature of the heater to oxidize the hydrocarbon therein and to raise the temperature of the second substrate and the exhaust gas passing therethrough;

a particulate filter device having an inlet and an outlet in fluid communication with the exhaust gas conduit downstream of the second substrate and configured to receive the heated exhaust gas therefrom; and a selective catalytic reduction catalyst applied to the particulate filter device downstream of the second substrate.

2. The exhaust gas after treatment system of claim 1, wherein the total volume of the first and second substrate is in the range of 4 to 6 liters, the volume of the first substrate is in the range of 2 to 4 liters, the volume of the second substrate is in the range of 1 to 2 liters, and a catalyst compound is applied to the electric heater.

3. The exhaust gas after treatment system of claim 2, further comprising a first temperature sensor positioned downstream of the second substrate, and a second temperature sensor positioned downstream of the first temperature sensor and upstream of the particulate filter device, the first temperature sensor operable to determine a temperature of the second substrate, and the second temperature sensor operable to determine a temperature of the particulate filter device and the selective catalytic reduction catalyst.

4. The exhaust gas after treatment system of claim 1, wherein the first substrate has a larger volume than the second substrate.

5. The exhaust gas after treatment system of claim 1, further comprising:

a catalyst compound applied to the electric heater, the first substrate, and the second substrate.

6. The exhaust gas after treatment system of claim 5, wherein the catalyst compound comprises a platinum group metal comprising one of platinum (Pt), palladium (Pd), rhodium (Rh) or other oxidizing catalysts, or combination thereof.

7. The exhaust gas after treatment system of claim 1, wherein the selective catalyst reduction catalyst includes a zeolite and a base metal component comprising one of iron ("Fe"), cobalt ("Co"), copper ("Cu") or vanadium, or a combination thereof.

8. The exhaust gas after treatment system of claim 1, wherein the particulate filter device comprises:

a ceramic monolith filter having exhaust flow passages extending therethrough defined by longitudinally extending walls therebetween, the exhaust flow passages comprising:

a first subset of inlet passages having an open inlet end and a closed outlet end; and a second subset of outlet passages having a closed inlet end and an open outlet end, wherein the exhaust gas enters the ceramic monolith through the inlet passages and migrates through the longitudinally extending walls to the outlet.

9. The exhaust gas after treatment system of claim 1, further comprising:

a controller in signal communication with the selective catalyst reduction catalyst coated particulate filter device through a sensor configured to measure the temperature thereof to activate the electric heater and the fuel injector when the measured temperature is below the operating temperature thereof.

10. The exhaust gas after treatment system of claim 1, further comprising:

a controller in signal communication with the particulate filter device through a sensor configured to measure the pressure differential there across to activate the heater and the fuel injector when the measured pressure differential has reached a level indicative of the need to heat the exhaust gas filter and burn exhaust gas particulates collected therein.

11. A method for operating a portion of an exhaust gas after treatment system for an internal combustion engine having an exhaust gas conduit in fluid communication with, and configured to receive an exhaust gas from, the internal combustion engine, an oxidation catalyst device having an inlet and an outlet in fluid communication with the exhaust gas conduit and having a first substrate, an electric heater, and a second substrate disposed serially between the inlet and the outlet, the second substrate disposed directly downstream of the heater, the first substrate having a larger thermal mass than the second substrate, a fuel injector connected to and in fluid communication with the exhaust gas conduit upstream of the oxidation catalyst device for delivery of a hydrocarbon thereto and formation of an exhaust gas and hydrocarbon mixture therein, and a selective catalyst reduction device having an inlet and an outlet in fluid communication with the exhaust gas conduit downstream of the oxidation catalyst device and configured to receive the heated exhaust gas therefrom comprising:

monitoring the temperature of the selective catalyst reduction device;

determining if the temperature of the selective catalytic reduction device is at a level at which it can reduce $NO_x$ in the exhaust gas;

activating the electric heater disposed directly upstream of the second substrate if it is determined that the temperature of the selective catalytic reduction device is less than required for reduction of $NO_x$ in the exhaust gas;

monitoring the temperature of the electric heater to determine if the temperature of the electric heater is at a level at which it can oxidize hydrocarbon in the exhaust gas;

activating the fuel injector if the temperature of the electric heater has reached a temperature at which it can oxidize hydrocarbon in the exhaust gas;

monitoring the temperature of the selective catalytic reduction device to determine if the temperature of the selective catalytic reduction device has reached a temperature at which it can reduce levels of $NO_x$ in the exhaust gas; and after the electric heater has reached the temperature at which it can oxidize hydrocarbon in the exhaust gas, continuing to operate the heater until the selective catalytic reduction device has reached the temperature at which it can reduce levels of $NO_x$ in the exhaust gas.

12. The method for operating a portion of an exhaust gas after treatment system for an internal combustion engine of claim 11 wherein the selective catalyst reduction device comprises a particulate filter device, the method further comprising:

monitoring the pressure differential across the selective catalyst reduction device;

determining if the pressure differential is at a level indicative of the need to heat the particulate filter device and burn exhaust gas particulates collected therein;

activating the heater if the pressure differential is at a level indicative of the need to heat the particulate filter device and burn exhaust gas particulates collected therein;

monitoring the temperature of the electric heater to determine if the temperature is at a level at which it can oxidize hydrocarbon in the exhaust gas; and activating the fuel injector if the temperature of the electric heater has reached a temperature at which it can oxidize hydrocarbon in the exhaust gas.

13. The method for operating a portion of an exhaust gas after treatment system for an internal combustion engine of claim 12, wherein the system includes reductant injector, the method further comprising:

after the temperature of the selective catalytic reduction device has reached a temperature at which it can reduce levels of $NO_x$ in the exhaust gas, activating the reductant injector to inject reductant into the exhaust gas conduit downstream of the second substrate and upstream of the selective catalytic reduction device.

* * * * *